US006194647B1

(12) United States Patent
Tateno

(10) Patent No.: US 6,194,647 B1
(45) Date of Patent: Feb. 27, 2001

(54) METHOD AND APPARATUS FOR PRODUCING A MUSIC PROGRAM

(75) Inventor: Tetsuro Tateno, Fukuoka (JP)

(73) Assignee: Promenade Co., Ltd, Tokyo (JP)

( * ) Notice: Subject to any disclaimer, the term of this patent is extended or adjusted under 35 U.S.C. 154(b) by 0 days.

(21) Appl. No.: 09/377,369

(22) Filed: Aug. 18, 1999

(30) Foreign Application Priority Data

Aug. 20, 1998 (JP) ..... 10-234283

(51) Int. Cl.[7] ..... G10H 1/26
(52) U.S. Cl. ..... 84/609
(58) Field of Search ..... 84/609–614, 634–638; 434/307 A

(56) References Cited

U.S. PATENT DOCUMENTS 5,824,932 * 10/1998 Nakata ..... 84/609
5,877,445 * 3/1999 Hufford et al. ..... 84/609 X
5,902,948 * 5/1999 Haruyama ..... 84/609
5,941,711 * 8/1999 Iida et al. ..... 434/307 A
5,962,802 * 10/1999 Iizuka ..... 84/609
5,986,200 * 11/1999 Curtin ..... 84/609
5,990,404 * 11/1999 Miyano ..... 84/609
5,990,406 * 11/1999 Nakamura et al. ..... 84/609
5,990,407 * 11/1999 Gannon ..... 84/609 X

* cited by examiner

*Primary Examiner*—Stanley J. Witkowski
(74) *Attorney, Agent, or Firm*—Smith-Hill and Bedell

(57) ABSTRACT

A method for editing a program and an apparatus for editing a program applicable to a program editing work required in a TV broadcasting or a radio broadcasting utilizes evaluation data which corresponds to a piece of music and is converted to numerical values and stored as music concept data. When the same piece of music is selected, the evaluation data is used and then the music concept data is revised. A difference data between the music concept data and the input evaluation data is stored as a sensitivity data of each of the directors in charge of the programs. Program data including pieces of music to be used in that program and their sequence is edited while storing the sensitivity data. Since the music concept data is revised every time the same piece of music is selected, the more the number of times of selection of music, the more average value of music concept data. Upon application of the evaluation data, it is possible to pick up the piece of music coincided with the music concept from the music concept data. Upon selection of a name of the director in charge, application of the sensitivity data of that director in charge enables a piece of music, which the director would likely select, to be selected on the basis of the music concept data. Thereby, an automatic program editing work can be realized.

3 Claims, 4 Drawing Sheets

METHOD AND APPARATUS FOR PRODUCING A MUSIC PROGRAM

BACKGROUND OF THE INVENTION

1. Field of the Invention

This invention relates to a method for editing a program and an apparatus for editing a program. This invention relates, more particularly, to a method for editing a program and an apparatus for editing a program applicable to a program editing work for editing a music program such as the one in a TV broadcasting or a radio broadcasting wherein they eliminate waste in editing a program and enable an editing time for editing the program to be shortened by editing the program while an individuality of a person who edits the program is being left as a past history and utilizing information about that history when a next program is edited.

2. Description of Related Art

When a program for a TV broadcasting or a radio broadcasting, for example, a program mainly constituted by music, is to be edited, it is normally carried out that a director in charge of that program or an assistant to that director (hereinafter called "the director in charge") selects pieces of music (sometimes referred to herein as sound sources) to be used in sequence while selecting pieces of music corresponding to the editing policy of the director in charge of that program in accordance with the program editing policy thereof. Then, they edit one program.

However, although it is of course apparent that when one program is to be edited, pieces of music to be selected are also widely different in reference to a concept of the director in charge, it is usual that some reasons about, i.e., what concept is applied for editing that program, on what reasons pieces of music are selected or why that piece of music is used in a first scene of the program or the like, are not left as records.

Accordingly, when a similar program is edited again, although a situation of the former program or the like can be referred, it is not possible for another director to edit a new program in reference to the record (the editing history of the past programs) when those programs have been made. This is because the editing concept of the director in charge who has edited those programs is unknown.

Due to this fact, it is an actual situation that even in the case that a similar program is edited, the same editing time as the previous editing time is consumed and an efficient editing of program can not be carried out.

It is also of course difficult for another person to perform a new editing of a similar program under the same sensitivity as that of the director in charge who has edited the program. This is because there is no presence of the information deriving sensitivity of the director in charge who has edited the program.

If some information such as information (sensitivity data) expressing the sensitivity of the director in charge who has edited the programs is stored, it becomes possible to utilize that sensitivity data or the like when a similar program is edited, resulting in that it can realize an editing of program which approaches the sensitivity of the director in charge who has edited the program as near as possible.

SUMMARY OF THE INVENTION

In reference to the foregoing, the object of the present invention is to provide a method for editing a program and an apparatus for editing a program wherein an efficient program editing operation and a simplified program editing operation are attained by storing the data of editing concept of the director in charge of that program when the program is to be edited, the data being changed into numerical values as much as possible, and practically utilizing the stored data in selecting pieces of music and their sequence when a next program editing is carried out.

In carrying out the invention in one preferred mode, I provide a method for editing a program wherein the program is made by editing a music program, comprising the steps of generating music concept data based on a plurality of evaluation parameters converted to numerical values corresponding to a piece of music selected by a selector, updating the music concept data referring to an evaluation data already stored and storing the updated music concept data, generating data of the selector who selects the piece of music from the music concept data and the input evaluation data and storing it as a personal sensitivity data, and generating program data including a piece of music and a sequence thereof by adding them to difference data between the music concept data and the input evaluation data.

As another preferred mode, I provide an apparatus for editing a program comprising a sound source storing means for storing many sound sources, a sound source server for getting the sound source specified with a program editing operation from the sound source storing means and storing it, a work station for editing the program, and a data base server for storing data. The data includes program data including a piece of music to be broadcast in a program and a sequence thereof, music concept data having evaluation data corresponding to the piece of music, the music concept data being changed into numerical values and sensitivity data generated on the basis of the music concept data and the input evaluation data.

In the present invention, the evaluation data expressing a music concept in respect to the selected piece of music (a sound source) is converted to numerical values and the converted data is stored. Since the evaluation data (music concept data) converted to numerical values is updated under a selection of the same piece of music, the more the times of selecting pieces of music, the more mean music concept data against the piece of music. Accordingly, it is possible to pick up a piece of music, which is coincided with the music concept, from the music concept data by applying the evaluation data.

In this invention, the sensitivity data for each of the directors in charge is stored. When a director in charge is selected, a piece of music, which the director in charge might select, is selected on the basis of the music concept data by application of the sensitivity data of that director in charge without attendance of the director. An automatic program editing operation can be carried out thereby. In addition, even if the director in charge is not directly nominated, specifying the sensitivity data of that director in charge enables the director in charge to be selected.

Accordingly, application of the apparatus capable of realizing such the method for editing a program enables the history of program editing work in the past time to be utilized, so that a program editing work can be simplified.

A further understanding of the nature and advantages of the invention may be realized by reference to the following portions of the specification and drawings.

DESCRIPTION OF THE PREFERRED EMBODIMENTS

Figure 1:
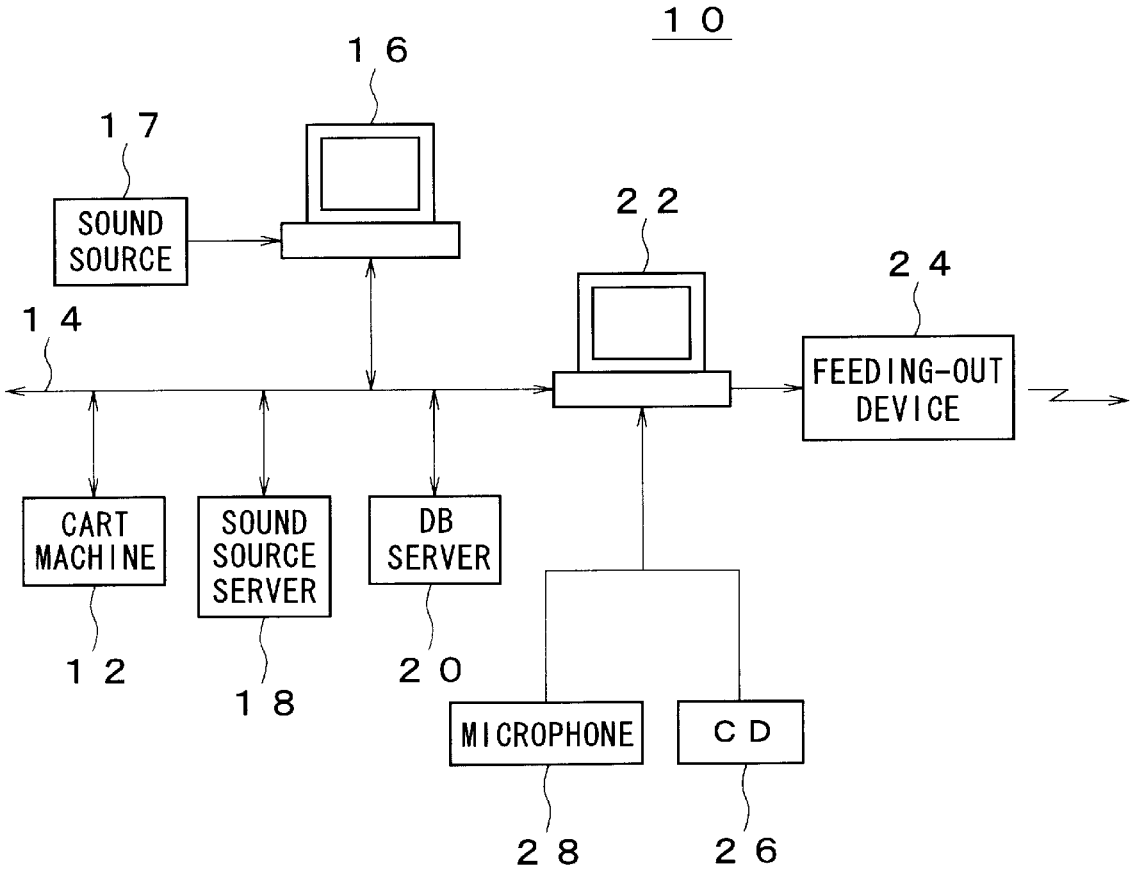
FIG. 1 is a systematic view showing a substantial part of a program editing apparatus according to one preferred embodiment of the present invention.

Referring now to the drawings, preferred embodiments of a method for editing a program and an apparatus for editing a program in accordance with the present invention will be described in detail.

FIG. 1 is a systematic view showing a substantial part of a program editing apparatus 10 according to one preferred embodiment of the present invention.

In the present invention, a large number of sound sources (acoustic data) are stored in a large storage memory device, i.e., a cart machine 12 in this example. In this case, a cart machine wherein sound sources are stored in a disk such as a DVD-RAM (Digital Video Disk-Random Access Memory) with their content being compressed (compression of acoustic data compressed by MPEG (Moving Picture Experts Group)), a plurality of disks each storing sound source are stored at a plurality of shelves in the cart and then a desired sound source is retrieved from each of the stored disks, is used.

As described above, when the sound sources are stored in advance in a disk or the like, getting of the sound sources can be easily carried out due to the fact that a processing of reproducing the sound sources to be become a specific source and recording it in a memory device every time a program is edited can be entirely eliminated. Since the information recorded in the disk can be easily copied in another disk, it is also possible to sell these disks having sound sources stored therein as a single product.

When a DVD-RAM disk is used, the disk becomes a large storage type memory device of about 0.9 to 1.8 tera-bytes (TB) as its entire storage capacity, so that several ten thousand to several hundred thousand pieces of music can be stored in one cart machine 12.

In place of a cart machine having the DVD-RAM disk, it is also applicable that a cart machine having a CD-R (Compact Disk-Rewritable) disk is used. In the case of this disk, one disk can store 600 pieces of music. Therefore, when the cart machine is composed of 100 disks therein, the sound source of about sixty thousand pieces of music can be stored in one cart machine. In the case of a constitution of 2-channels, about 120 thousand pieces of music of twice of that of one channel can be stored in one cart machine.

An input work station 16 acting as a terminal device is connected by a bus line 14 and connected to a reproducing means 17 such as a disk or a tape and the like acting as a sound source. The input work station 16 receives the sound source from the reproducing means 17 and transmits the sound source to the cart machine 12 through the bus line 14 to store it on the cart machine 12. As the input workstation 16, a personal computer is used.

Since a reading time of the cart machine 12 itself is not so high speed, the sound source actually used in this cart machine is stored in advance within a sound source server 18 for a broadcast. As the sound source server 18, a disk array device having a redundancy (RAID: Redundant Array Inexpensive Disks) or the like can be used. The sound source server 18 can store the sound source in a case that it is selected by the input work station 16 when a program is edited. A program is made under a utilization of the input workstation 16. The program is composed of a plurality of sound sources and their list is produced under a sequence of the sources.

If it is assumed that data concerning on what order pieces of music (the sound source) is fed out is defined as a program data, the program data produced in this way is stored in a data base server (DB server) 20 connected to the bus line 14. Since it is necessary that the data base server 20 has a certain storage capacity, the disk array device is constituted by the aforesaid RAID of 2 channels. A disk array device for one channel is used for an emergency case.

In addition to the production of the program data, this input workstation 16 also makes feeding-out schedule information (program feeding-out data) such as a broadcasting date (a date in which the program data is fed out (hour, minute, second)), a program title, a broadcasting channel or the like. The produced program feeding-out data is similarly stored in this data base server 20.

The bus line 14 is also connected to a feeding-out work station 22 for supervising other data to be fed out, wherein the compressed sound source data read out of the sound source server 18 is fed to a program feeding-out device 24 under a state in which the compressed sound source data is extended.

To the feeding-out work station 22 are connected additionally some external sound source means such as a digital sound source 26 such as a CD (a Compact Disk) and an analogue sound source 28 such as amicrophone. This enables some operations such as a changing-over of the sound source data from the sound source server 18 or a mixing operation to be carried out.

The program feeding-out device 24 feeds out a program to some viewers. The feeding-out of a program can also be carried out while a relay means or the like is being placed in the midway part of the system. When the program feeding-out device 24 is installed within a small-sized studio, a program is fed out through the relay means. In such a case, a switching device, a broadcasting satellite and an existing broadcasting station or the like can be applied as relay means.

Figure 2:
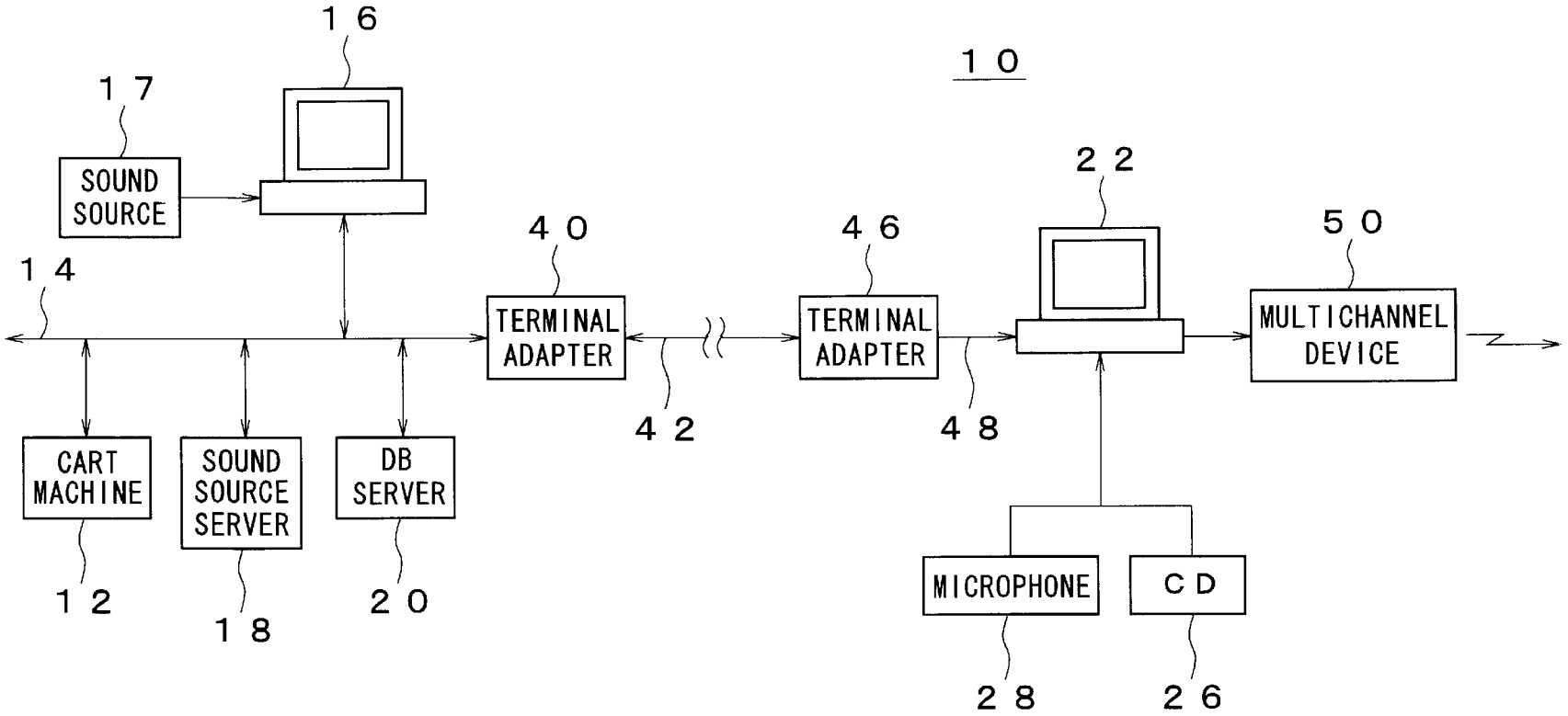
FIG. 2 is a systematic view showing a substantial part of a program editing apparatus according to another preferred embodiment of the present invention.

FIG. 2 illustrates another preferred embodiment of the present invention, wherein a terminal adapter (including a routing device) connected to a bus line 14 is connected to a terminal adapter 46 in a feeding-out work station 22 side through a WAN (Wide Area Network: utilizing an ISDN circuit line) 42. The feeding-out workstation 22 is connected to the bus line 48 connected to this terminal adapter 46.

The feeding-out workstation 22 can feed out a program data directly to the program feeding-out device 24. The feeding-out workstation 22 may also feed out the program data to the program feeding-out device 24 through a multichannel device 50 or the like as shown in FIG. 2 to constitute a multichannel feeding-out system. The multichannel device 50 can also feed out an output signal once to the aforesaid relay means and broadcast it through the relay means.

Subsequently, one preferred embodiment of the method for making a program in accordance with the present invention will be described as follows.

In the present invention, a history of various kinds of information at the time of producing a program is developed by accumulating information such as sensitivity of a director in charge while the program is being made and changing an editing concept into numerical values and storing them, not by merely making (editing) a program to be fed out. When the history of making program can be stored as information, that information can be referred to when program editing work is carried out subsequently and then the program editing work can be shortened. Since the history of making a program is revised every time the program is edited, such a method for editing a program as above is one of the methods for editing a program having a function of study.

Figure 3:
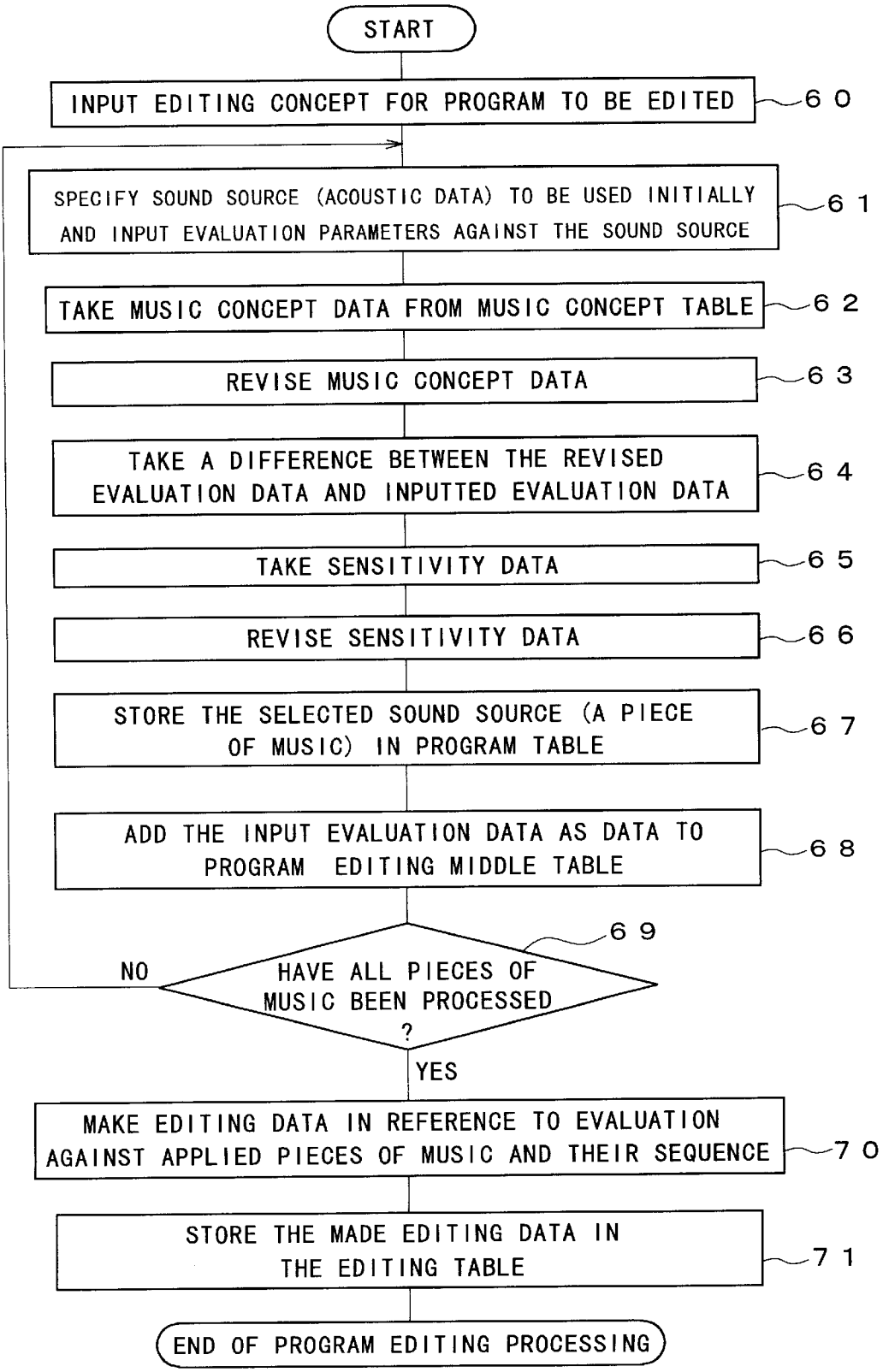
FIG. 3 is a flowchart forshowingaprogram editing method according to one preferred embodiment of the present invention.

Subsequently, one preferred embodiment of the method for editing the program in accordance with the present invention will be described in reference to a flow chart of FIG. 3.

The director in charge of a program at first determines an editing concept of that program and inputs the information about it (step 60) because a content and a length of a piece of music and the like to be used in that program are made different in reference to the content of the program. The director in charge of the program specifically determines an editing concept based on an age bracket (middle or higher ages, young people and children) as well as coinciding with program contents such as an entertainment program or an education program or a program of nature trip or a memorial program, a time schedule for the program, a joyful program or a rather peaceful program and the like.

Then, the director in charge specifies a piece of music to be used initially in accordance with the editing concept for that program (only acoustic data acting as the sound source) (Step 61). As this sound source, the source stored in the sound source server 18 is used. Then, in concurrent with the selection of this piece of music, the director in charge inputs the data of music concept (evaluation parameters) of the sound source in reference to the contents of the program against the sound source to be used (Step 61).

The music concept data comprises information of the reason why the director in charge selected that sound source. Then, each of the evaluation parameters such as a slow tempo or fast tempo, long or short playing time of the sound source, a dark tone music or a bright tone music or its middle tone music, the music used at the leading part of the program or at a terminal part of the program or at a middle part of the program, in addition to a genre of the sound source (classic music, popular music, jazz music, rock music and the like) as the music concept data against the sound source, is converted to numerical values, for example, 3- to 5-steps evaluation, and this music concept data is input. The music concept data is stored in a music concept table of the data base server 20.

Some evaluation parameters expressing the music concept data are illustratively prepared as follows:

1. Brightness of the sound source (bright/normal/dark);
2. Feelings to weight of the sound source (heavy/normal/light);
3. Speed of the sound source (fast/normal/slow);
4. Playing time of the sound source (long/middle/short);
5. Pitch of the sound source (high sound/middle sound/low sound);
6. Number of tones of the sound source (many/normal/less);
7. Degree of celebration of the sound source (major/normal/minor);
8. Men's or women's preference against the sound source (for men/for both men and women/for women);
9. Target ages of the sound source (children/young people/adults/aged people);
10. Impression of the sound source (cold/warm/hot);
11. Humidity impression of the sound source (dry/normal/wet);
12. Hardness impression of the sound source (soft/normal/hard);
13. Number of times of use of the sound source.

In turn, the director in charge may take the past music concept data against the same sound source from the table of the music concept (Step 62). The music concept data is data stored in the data base server 20 and it has a certain music concept against one sound source (resulting in that it is an aggregation of the evaluation parameters of the same number as those described above).

The music concept data is expressed as values in which various kinds of evaluation performed by several directors in charge who have selected the pieces of music is averaged. Such the music concept data is accumulated and averaged so that the information thus obtained is separate from a scope of personal information selected by the director in charge and evolved into a usual information expressing a mean music concept provided by the sound source. Since the music concept data is revised every time the sound source is used, the higher a frequency of use of the sound source, the more mean state the music concept against the sound source, and the music concept is changed into a universal one. The music concept data is defined as common music concept data hereinafter.

Accordingly, the common music concept data taken from the table of the music concept is processed for an average state under application of the evaluation parameters input at the step 61 and then revised (Step 63). The revised common music concept data is accumulated in the common music concept table in the data base server 20.

Subsequently, the revising operation for the sensitivity data accumulated in the sensitivity table is carried out (steps 64 to 66). In this case, the sensitivity table is also a memory region prepared in the data base server 20. The sensitivity data is personal information owned by each of the directors in charge. Namely, the sensitivity data is music concept data (specific music concept data) specific to each of the directors in charge.

The specific music concept data is a difference data between the common music concept data stored in the music concept table and evaluation data actually inputted by a director in charge. A personality or a sensitivity of that director in charge can be expressed by such the specific music concept data. Due to this fact, a processing on the difference between the revised evaluation data and the input evaluation data is carried out (Step 64).

In order to revise the data indicating the new difference as a sensitivity parameter of the director in charge proper, the sensitivity data of the director in charge is taken from the sensitivity table stored in the data base server 20 (Step 65). Then, the data is revised (Step 66).

Subsequently, the selected sound source (a piece of music) is accumulated in the program table (a step 67). The program table is also assured in memory region of the data base server 20. The program table monitors a broadcast order of pieces of music to be used in the edited program.

Then, the selected sound source and the program editing middle table for monitoring the broadcast order of pieces of music as data are taken from the data base server 20, thereby adding input evaluation data against the selected sound source to the program editing middle table (Step 68). Since adding the evaluation data to the broadcast order of pieces of music causes the music concepts to be arranged in a direction of time axis, it is possible to change the flow of music concept (transition) within the entire program into the numerical values and then it is expressed by the numerical values.

The aforesaid processing is performed for all pieces of music to be used within a time of that program (Step 69), resulting in that an editing middle table for the new edited program is completed. After this operation, the data in the editing middle table is taken again to perform a correcting operation and then the final program editing data is made (Step 70). Accordingly, the program editing data includes various kinds of data expressing a kind of evaluation on sound source and a selected order of pieces of music. Therefore, the data for each of the directors in charge is stored in the data base server 20 (Step 71).

In addition to the program table actually used in the broadcasting operation, if there is prepared in advance a program editing table monitored for each of the directors in charge, the program editing table is opened to enable a person to acknowledge it as data changed into numerical values as to a type of music concept that the director in charge arranges the sound sources in one program and an editing concept under which the director in charge edits that program.

Accordingly, in the case that a similar program is to be edited, it is possible for another director in charge to perform the editing processing while the past program editing data is being referred to, so that the program editing and processing time can be shortened and the editing operation can be simplified. In addition, if the program editing data and the sensitivity data of each of the directors in charge are utilized, the program editing near the sensitivity of the director in charge who has edited the program may become possible.

Figure 4:
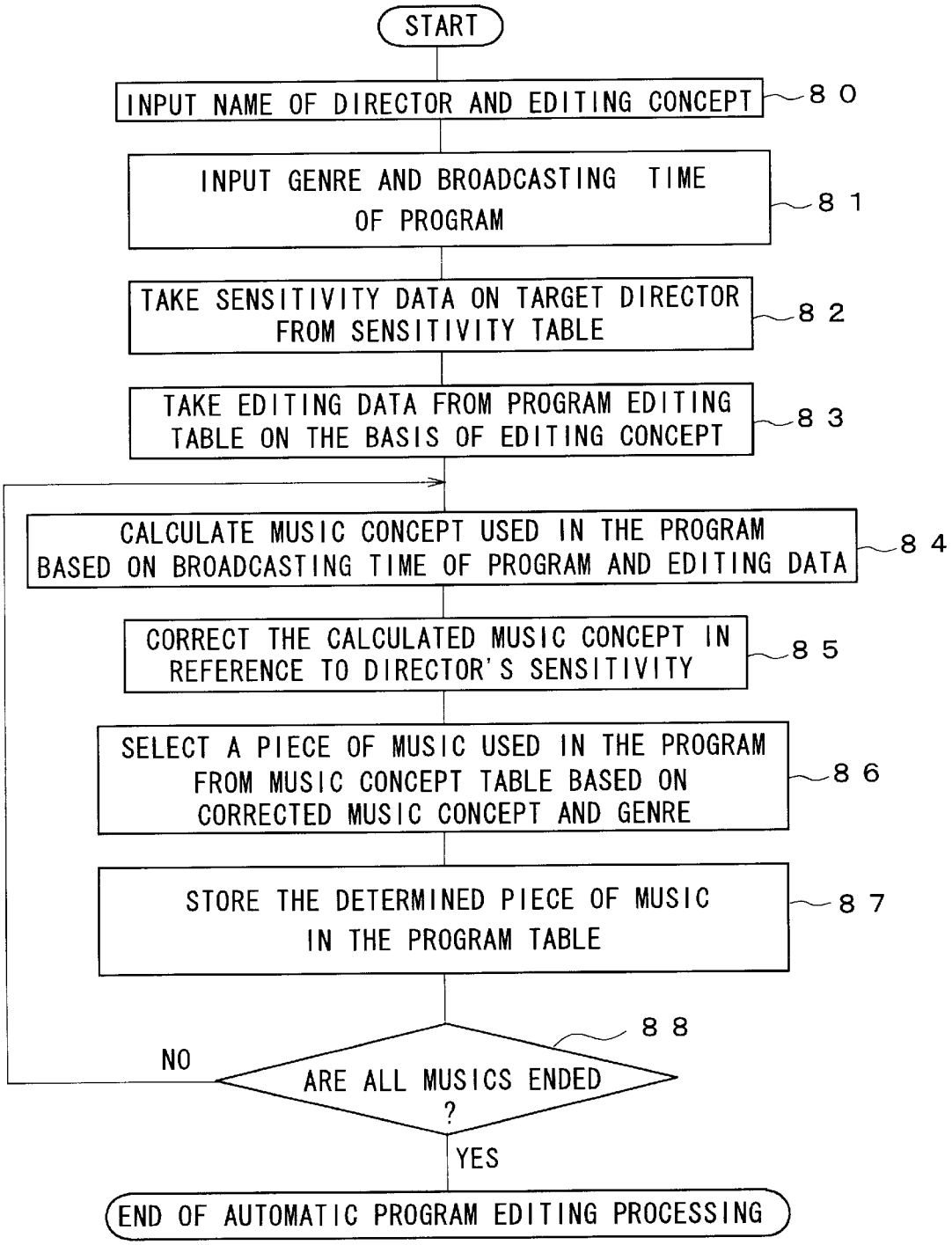
FIG. 4 is a flow chart for showing an automatic program editing method as one preferred embodiment, to which the present invention can be applied.

Subsequently, referring now to a flow chart of FIG. 4, one preferred embodiment of an automatic program editing process performed under utilization of such program editing data as described above will be described as follows.

Upon determination of the program to be edited, the name of the director in charge of that program and the editing concept of that program are inputted (Step 80). Then, the genre of the program and the broadcasting time of the program are inputted (Step 81). The sensitivity data of the specified director initially is taken out of the sensitivity table on the basis of these input data (Step 82). Concurrently, the editing data is attained from the program-editing table in reference to the specified director data and the editing concept data (Step 83).

Since the name of the specified director in charge and many editing data used by the director in charge in the past during the program editing operation can be attained through taking of the aforesaid data, a music concept (music concept data) required in that program is calculated on the basis of evaluation data contained in the editing data and a broadcasting time of the program to be edited from now on (Step 84).

The calculated music concept is corrected on the basis of the sensitivity data of the director in charge (Step 85) and the most-suitable piece of music to be used in the program is determined in sequence from the music concept table under utilization of the corrected music concept and the genre (Step 86). The determined piece of music is stored in the program table (Step 87).

Such a process as described above is continued until one program is edited (Step 88) to enable one program to be edited. Thereby, an automatic editing of program may be performed by another person in reference to a sensitivity of the director in charge who has edited the program without such a director in charge.

In this way, the music concept of that program is changed into numerical values under utilization of the past editing data and the music concept changed into numerical values is modified with sensitivity data. Further, the sound source coinciding with the modified music concept is picked up from the music concept table and these operations are repeated to enable an automatic program editing based on the sensitivity of the director to be carried out.

As described above, in the present invention, the program is edited by a method wherein a music concept of a director in charge who has edited a program is changed into numerical values as much as possible and changed music concept is stored and in the case that pieces of music and their sequence are selected when a next program is to be edited, the program can be edited while the stored data is being utilized.

In accordance with the aforesaid system, since the past program editing information can be utilized, the present invention has a feature that an efficient program editing work as well as its simplified editing operation can be attained. The program editing operation coinciding with a sensitivity of the director can also be performed automatically.

Thus, it is quite preferable for the present invention to be applied to a case in which a program editing work is required in a TV broadcasting or a radio broadcasting.

While the above is a complete description of the preferred embodiments of the invention, various alternatives, modifications and equivalents may be used. Therefore, the above description should not be taken as limiting the scope of the invention as defined by the appended claims.

What is claimed is:

1. A method for selecting a piece of music and editing a sequence of selected pieces of music to produce music program data, said method comprising the steps of:

(a) generating and storing evaluation data based on a plurality of evaluation parameters converted to numerical values corresponding to the piece of music selected by a selector, said evaluation data relating to said piece of music;

(b) generating music concept data relating to the piece of music selected by the selector by averaging the evaluation data generated in step (a) and already stored evaluation data for that piece of music;

(c) updating and storing music concept data generated in step (b);

(d) generating, storing and updating personal sensitivity data of the selector from the music concept data and the input evaluation data, the personal sensitivity data being difference data between the music concept data and the input evaluation data; and (e) generating editing data for selecting said piece of music and editing the sequence of selected pieces of music based on said personal sensitivity data of the selector, the editing data allowing the music program to be produced.

2. An apparatus for selecting a piece of music and for editing a sequence of pieces of music to produce a music program data, said apparatus comprising:

a memory means for storing a multitude of pieces of music;

a server means for retrieving a piece of music specified with a program editing operation from said memory and storing the specified piece of music;

an editing means for allowing a selector to select a piece of music and edit a sequence of selected pieces of music according to the steps of:

generating and storing evaluation data based on a plurality of evaluation parameters converted to numerical values corresponding to the piece of music selected by a selector, said evaluation data relating to the selected piece of music;

generating music concept data by averaging input evaluation data and already stored evaluation data;

updating and storing said generated music concept data;

generating, storing and updating personal sensitivity data of the selector from the music concept data and the input evaluation data, the personal sensitivity data being difference data between the music concept data and the input evaluation data; and generating editing data for selecting said piece of music and editing the sequence of selected pieces of music based on said personal sensitivity data of the selector, the editing data allowing the music program to be produced; and a data base server means for storing data, said data including the music program data including the piece of music to be broadcast in a program and a sequence thereof, the evaluation data, the music concept data, and the personal sensitivity data of the selector.

3. Apparatus according to claim 2, further comprising a feed-out workstation for feeding-out said edited program.

* * * * *